United States Patent [19]

Barkan et al.

[11] 4,137,436

[45] Jan. 30, 1979

[54] MEANS FOR MANUALLY SLOW-CLOSING A CIRCUIT BREAKER THAT HAS A SPRING-ACTUATED OPERATING DEVICE

[75] Inventors: Philip Barkan, Media; Robert S. Barton, Bryn Mawr, both of Pa.

[73] Assignee: General Electric Company, Philadelphia, Pa.

[21] Appl. No.: 707,167

[22] Filed: Jul. 21, 1976

[51] Int. Cl.[2] ..... H01H 3/00

[52] U.S. Cl. ..... 200/153 SC; 185/40 B; 200/50 A; 200/50 AA

[58] Field of Search ..... 200/153 SC, 50 A, 50 AA; 185/37, 40

[56] References Cited

U.S. PATENT DOCUMENTS

| | | | |
|---|---|---|---|
| 2,909,629 | 10/1959 | McCloud | 200/153 SC |
| 3,045,083 | 7/1962 | Gamel et al. | 200/153 SC X |
| 3,084,238 | 4/1963 | Baskerville | 200/153 SC |
| 3,876,847 | 8/1975 | Dykes | 200/153 SC |
| 3,905,247 | 9/1975 | Cook | 192/33 R |

*Primary Examiner*—Harold Tudor
*Attorney, Agent, or Firm*—William Freedman

[57] ABSTRACT

An operating device for an electric circuit breaker comprises a closing spring and a rotatable spring-controller mounted for rotation between first and second dead-center positions with respect to the spring. The spring is charged by transmitting rotational forces to the spring-controller through a main pawl mounted on the spring-controller and an abutment on a rotatable driving member. The main pawl is released from driven engagement with the abutment at the end of a spring-charging operation. Normal circuit-breaker closing is effected by allowing the spring to quickly discharge after a charging operation.

A manual slow-close operation of the circuit breaker is effected through an auxiliary pawl mounted on the spring-controller in a position angularly-spaced from the main pawl. During normal spring-charging and discharging operations, this auxiliary pawl is prevented from engaging the abutment on the driving member. But when a manual slow-close operation is to be effected, engagement between the auxiliary pawl and the abutment is allowed. Rotation of the driving member during such engagement rotates the spring-controller through a slow-close operation. This slow-close operation is effected without assistance from the closing spring since prior to the manual slow-close operation, the closing spring is disabled while in its charged condition and held disabled during the slow-close operation.

22 Claims, 5 Drawing Figures

MEANS FOR MANUALLY SLOW-CLOSING A CIRCUIT BREAKER THAT HAS A SPRING-ACTUATED OPERATING DEVICE

BACKGROUND

This invention relates to an operating device for an electric circuit breaker that is powered by a closing spring and, more particularly, relates to means for manually slowclosing the circuit breaker while the closing spring is disabled, or "gagged," in its charged condition.

The present invention is especially, though not exclusively, suited for use with the spring-actuated circuit breaker operating device disclosed and claimed in copending application Ser. No. 702,328-Barkan, filed July 2, 1976, and assigned to the assignee of the present invention. That operating device comprises a closing spring, a rotatable spring-controller mounted for rotation between first and second dead-center positions with respect to the spring, and means for transmitting charging forces to the spring in response to rotation of the spring-controller in a forward direction toward said first dead-center position. The spring acts to discharge and thereby further rotate the spring-controller in a forward direction when the spring-controller has been forwardly rotated past said first dead-center position. But releasable stop means coacts with the spring-controller to block this further forward rotation of the spring-controller. When the stop means is released, the spring is permitted to rapidly discharge and continue further forward rotation of the spring-controller into said second dead-center position. This latter rotation of the spring-controller is used to close the circuit breaker.

For charging the spring after a closing operation, the spring-controller is forwardly rotated from its second to its first dead-center position by a motor-driven rotatable driving member coupled to the spring-controller through a cooperating pawl and abutment. Just before the above-described stop is encountered by the spring-controller, the pawl and abutment are uncoupled, thus preventing the parts from being damaged by the impact resulting from this encounter.

When it is desired to effect a slow-closing operation in this general type of operating device, the closing spring is "gagged" in its charged condition, the stop means released, and the spring controller is slowly rotated by manual means through its usual closing stroke. This is the general procedure that we use, but we cannot utilize the above-described pawl and abutment for effecting such slow rotation of the spring-controller because the pawl and abutment are then uncoupled, as above described. It is, of course, possible to recouple the pawl and abutment to permit their use for such slow rotation of the spring controller. But such recoupling would involve structural complications and also complicated procedures that would have to be carefully followed to avoid damage to the operating device.

SUMMARY

An object of our invention is to provide means for effecting a manual slow-close operation of the circuit breaker without the necessity for first recoupling the above-described pawl and abutment.

Another object is to provide simple and reliable means for effecting a manual, slow-close operation, which means is highly immune to a damaging failure as a result of operator errors.

Another object is to accomplish each of the above objectives without the need for major modifications in the basic structure in the operating device of the aforesaid Barkan application Ser. No. 702,328.

Still another object is to employ for the desired manual slow-close operation an auxiliary pawl for cooperating with the above-described abutment, the auxiliary pawl being incorporated in such a way that it does not interfere with normal spring-charging and discharging operations.

In carrying out the invention in one form, we locate the main pawl on the aforesaid spring-controller and the abutment on the aforesaid driving member. In addition to the main pawl, we provide an auxiliary pawl, mounting it on the spring-controller in a position angularly-spaced from the main pawl. The auxiliary pawl is arranged to engage the abutment on the driving member when the driving member is manually rotated relative to the spring controller in a forward direction past the normal terminal position of the driving member at the end of a spring-charging operation. Additional manual rotation of the driving member in a forward direction while said abutment and said auxiliary pawl are engaged acts to rotate the spring-controller into the aforesaid second deadcenter position, thereby producing a manually-powered circuit-breaker closing operation. Means is also provided for effectively disabling the closing spring while the spring-controller is being manually rotated through said circuit-breaker closing operation.

BRIEF DESCRIPTION OF DRAWINGS

For a better understanding of the invention, reference may be had to the accompanying drawings, wherein.

DETAILED DESCRIPTION OF PREFERRED EMBODIMENT

Figure 1:
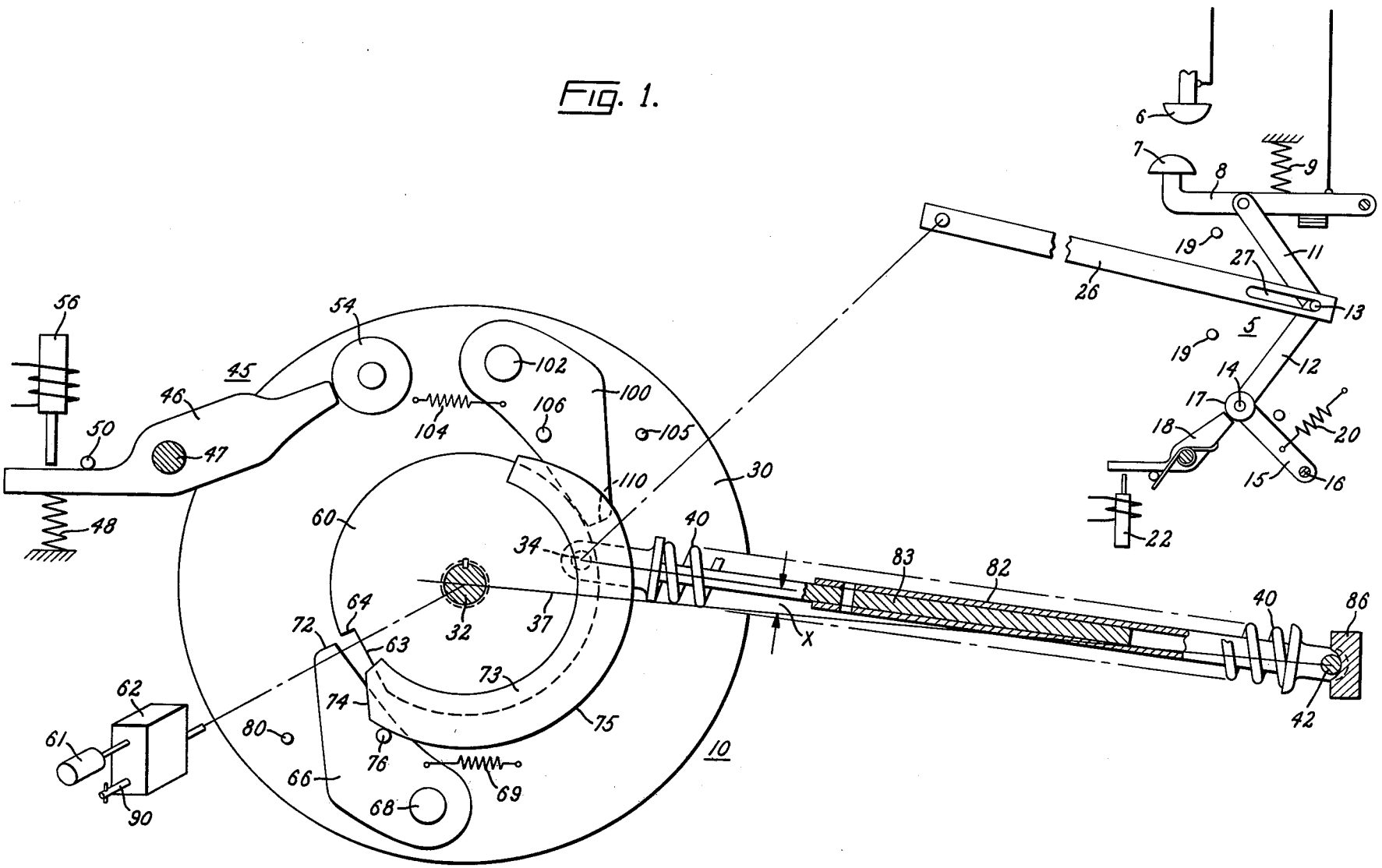
FIG. 1 is a schematic showing of our operating device depicting the parts in a position where the closing spring is fully-charged and the charging motor is coasting to a halt immediately following its deenergization. The circuit breaker is shown in an open position.

Referring now to FIG. 1, the stored energy operating device is shown at 10 and the circuit breaker which it is designed to close is shown at 5. This circuit breaker can be of any suitable conventional type and is therefore shown in simplified schematic form. For simplicity, its size relative to that of the operating device has been reduced.

THE CIRCUIT BREAKER 5

As shown in FIG. 1, the circuit breaker 5 comprises a pair of relatively movable contacts 6 and 7. Contact 6 is a stationary contact, and contact 7 is a movable contact carried by a pivotally mounted contact arm 8 biased to the open position shown in FIG. 1 by a suitable opening spring 9. Closing forces are transmitted to the movable contact arm 8 by a conventional mechanically trip-free operating mechanism which comprises a pair of toggle links 11 and 12 pivotally joined together by a knee 13. One of the toggle links 11 is pivotally connected at its opposite end to the movable contact arm 8, whereas the other of the toggle links 12 is connected by a pivot pin 14 to the left hand end of a guide link 15. Guide link 15 is pivotally supported at its right hand end on a fixed fulcrum 16. Pivot pin 14 carries a latch roller 17 which cooperates with a suitable trip latch 18. So long as trip latch 18 remains in its latched position shown, toggle 11, 12 is capable of transmitting thrust to the movable contact arm 8. Thus, when the knee 13 is driven to the left from its position of FIG. 1, toggle 11, 12 is extended toward an in-line position and thus drives the movable contact arm 8 upwardly toward its closed position of FIG. 2.

Closing force is transmitted to toggle knee 13 through a link 26 having a slot 27 therein freely receiving the toggle knee pin 13. When link 26 is driven to the left, it extends the toggle to produce circuit-breaker closing as above described. Preferably, link 26 is arranged to drive toggle 11, 12 slightly overcenter and against a stop 19 so that the movable contact will be held in its closed position even when the link 26 is returned to its original position of FIG. 1. Alternatively, a prop (not shown) may be spring driven into a position behind pin 13 to retain it in its closed position.

Should latch 18 be tripped when the circuit breaker is closed or even during a closing stroke, toggle 11, 12 will be rendered inoperative to transmit closing thrust to movable contact arm 8. As a result, the opening spring 9 will be free to drive movable contact arm 8 to its open position of FIG. 1. A suitable reset spring 20 cooperates with guide link 15 to reset the mechanism to its latched, thrust-transmitting condition after it has been tripped. The above-described tripping of latch 18 is accomplished in response to predetermined electrical conditions by operation of a suitable tripping solenoid 22.

THE STORED-ENERGY OPERATING DEVICE 10

For driving link 26 from its position of FIG. 1 to the left to produce the above-described closing of the circuit breaker, the stored-energy operating device 10 is relied upon. This operating device 10 comprises a rotatable flywheel 30, occasionally referred to herein as a spring-controller. Flywheel 30 is freely rotatable on a centrally-located shaft 32 and includes a crank pin 34 fixed thereto at a point spaced radially from the axis of the shaft 32. The above-described link 26 is pivotally connected to this crank pin 34.

Cooperating with flywheel 30 is a heavy compression spring 40 that has one end pivotally connected to crank pin 34 and its other end pivotally mounted on a pivot 42 that normally has a stationary axis. Flywheel 30 has two different dead-center positions with respect to spring 40. In a first one of these dead-center positions, the axis of crank pin 34 is located between the axis of shaft 32 and the axis of pivot pin 42 and on a reference line 37 interconnecting these latter two axes. In a second one of these dead-center positions, the axis of crank pin 34 is located on the same reference line 37 but on the opposite side of the axis of shaft 32.

In FIG. 1 the parts are depicted in a position wherein the crank pin 34 has been driven in a counterclockwise, or forward, direction slightly past the first dead-center position. Spring 40 is essentially fully charged and is biasing flywheel 30 in a counterclockwise direction but is blocked from discharging by a releasable stop 45. This releasable stop 45 comprises a prop latch 46 that is pivotally mounted on a stationary pivot 47. A compression spring 48 biases prop latch 46 into a set position against a fixed stop 50. In FIG. 1 the prop latch 46 is positioned in interfering relationship with a roller 54 carried by flywheel 30. Release of stop 45 is effected by means of a closure-initiating solenoid 56, which upon energization drives prop latch 46 in a counterclockwise direction out of interfering relation with roller 54.

Figure 2:
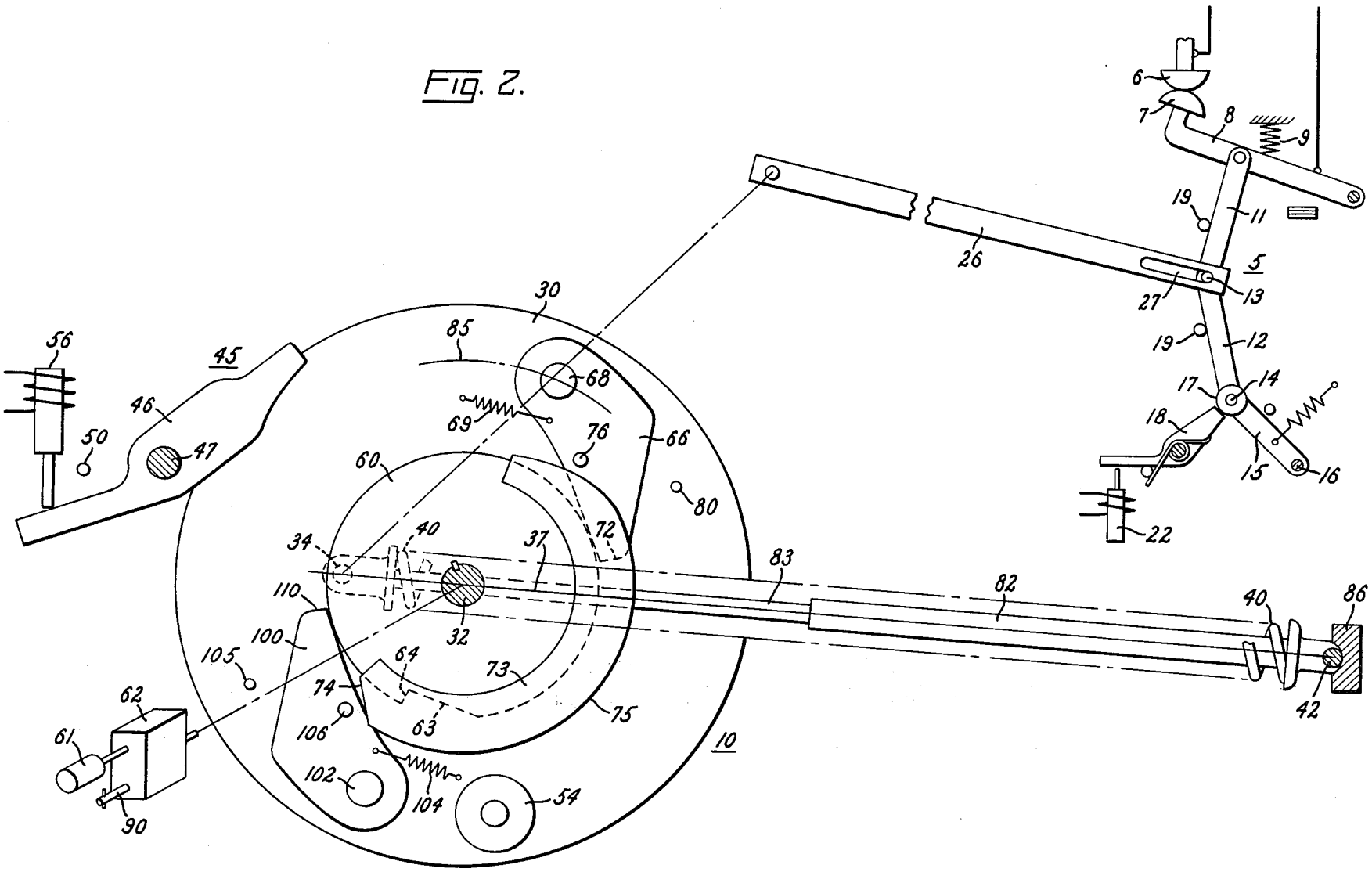
FIG. 2 is a schematic showing depicting the parts immediately after the spring has discharged and effected closing of the circuit breaker.

When stop 45 is thus released, main compression spring 40 is free to drive flywheel 30 in a counterclockwise direction from its position of FIG. 1 into its second dead-center position, which is shown in FIG. 2. This counterclockwise motion of flywheel 30 is transmitted to link 26 through crank pin 34 and acts to drive link 26 through a circuit-breaker closing stroke.

Compression spring 40 is recharged after the above-described discharge by driving flywheel 30 in a counterclockwise, or forward, direction from its position of FIG. 2 into its position of FIG. 1. During this recharging motion, the connecting link 26 moves to the right from its position of FIG. 2 into its position of FIG. 1, but this motion of link 26 has no effect on the toggle 11, 12 since the slot 27 in link 26 allows this motion to occur without transmitting force to knee pin 13. For driving flywheel 30 through this recharging motion, a rotatable driving member 60 is provided. This driving member 60 is keyed to the shaft 32 on which the flywheel is freely rotatably mounted. Shaft 32 is coupled to a small electric motor 61 through conventional reduction gearing 62. The motor is controlled in a conventional manner by a suitable control circuit (not shown), the operation of which will soon appear more clearly.

Driving member 60 has a circular periphery except for a notch 63 provided therein, which notch results in an abutment 64 being present on the driving member 60. This abutment 64 cooperates with a main pawl 66 carried by flywheel 30. Main pawl 66 is pivotally mounted on a pin 68 fixed to flywheel 30 and is biased in a clockwise direction about pin 68 by a suitable spring 69. The main pawl 66 has a working surface 72 that under certain conditions is engageable with abutment 64 to transmit driving motion between driving member 60 and flywheel 30. When driving member 60 is rotated in a counterclockwise direction from its position of FIG. 2, no driving force is transmitted to the flywheel 30 until the abutment 64 reaches a position of angular alignment with working surface 72 on pawl 66. When this position is reached, the pawl 66 is in notch 63 and the abutment 64 engages the working surface 72 of the pawl and thereafter transmits driving force through the pawl 66 to flywheel 30, thus producing counterclockwise spring-charging motion of the flywheel.

This counterclockwise spring-charging motion of the flywheel 30 is continued for slightly more than 180° until the flywheel is returned to its position of FIG. 1, where it is blocked by the stop 45. Such counterclockwise motion of the flywheel charges spring 40 until the previously-described first dead-center position is reached. Thereafter, flywheel 30 passes in a counterclockwise direction slightly beyond this dead-center position (typically about 10°) and into its overcenter, blocked position of FIG. 1.

RELEASE OF MAIN PAWL 66 FROM ABUTMENT 64 BY CAM 73

To prevent damage to the parts of the device when roller 54 on flywheel 30 encounters stop 45 after a spring-charging operation, the main pawl 66 is released from driven relationship with abutment 64 immediately after the first dead-center position has been reached but just prior to the roller's engaging the prop latch 46. Such release of main pawl 66 is effected by cam means comprising a stationary cam member 73 of generally arcuate form. The outer surface 74 of this cam member cooperates with a follower pin 76 on main pawl 66 and lifts pawl 66 radially-outwardly into a retracted position with respect to abutment 64 just before stop 45 is encountered. The parts are depicted in FIG. 1 just after such pawl-release has occurred and at the instant that the roller 54 encounters prop latch 46. Just prior to this instant, the motor 61 is deenergized by a suitable cut-off switch (not shown) responsive to position of the driving member 60, following which the motor and the driving member 60 coast to a gradual stop. The precise position at which the driving member 60 stops following such coasting is not critical, provided only that it is within the region protected by the cam 73, as will soon appear more clearly. Typically, this final position of the driving member 60 will be 30 to 60 degrees past the position shown in FIG. 1.

OSCILLATIONS OF FLYWHEEL 30 AT END OF A CLOSING OPERATION

When the stop 45 is later released to initiate closing of the circuit breaker 12, the spring 40 drives spring-controller 30 counterclockwise into its position of FIG. 2. The amount of excess kinetic energy remaining in the spring-driven parts after this closing operation will depend upon variations in electromagnetic and frictional forces and normal tolerance variations in spring forces. Any such excess energy remaining will carry the flywheel 30 past the dead-center position of FIG. 2 through additional forward rotation, thus partially recharging spring 40. Immediately after this partial recharging, the spring again discharges, this time driving the flywheel in a reverse direction through the dead-center position of FIG. 2 and again partially recharging the spring. Immediately thereafter, the spring again discharges to drive flywheel 30 in a forward direction through the dead-center position of FIG. 2. These oscillations of the flywheel about its dead-center position of FIG. 2 continue at high speed, but with decreasing amplitude, until the excess energy is finally dissipated and the flywheel comes to rest in its dead-center position of FIG. 2.

PROTECTING AGAINST POSSIBLE COLLISIONS RESULTING FROM OSCILLATIONS

A problem presented by these oscillations of the flywheel is that, under certain conditions, they can carry the flywheel in a reverse direction through sufficient travel to produce a damaging collision between the main pawl 66 and abutment 64 unless special protection against such collisions is provided. As pointed out in the aforesaid Barkan application Ser. No. 702,328, the cam 73 is relied upon as the principal means for providing such protection.

In this respect, when the flywheel 30, in traveling in a reverse direction during such oscillations, carries the follower pin 76 back onto surface portion 75 of the cam 73, the main pawl 66 is again retracted counterclockwise about its pivot 68. So long as the pawl 66 is so retracted, its working face 72 cannot engage the abutment 64, and thus damaging collisions between the pawl 66 and the abutment are prevented. The collision-preventing surface 75 of cam 73 (i.e., the constant radius portion of the cam surface that holds the pawl in its retracted position where its working face 72 cannot engage abutment 64) extends around the central axis of the flywheel by about 170°. Thus, even if the above-described oscillations should carry the flywheel through as much as 170° in a reverse direction from its dead-center position of FIG. 2, the cam 73 will be capable of preventing a collision between the main pawl 66 and abutment 64 during such reverse travel.

The maximum angular extent of the collision-preventing surface 75 is determined by the angular distance between the two dead-center positions (180°) minus the angle X of FIG. 1 between the first dead-center position and the position of crank pin 34 when the flywheel is blocked by stop 45. Typically, the angle X is about 10°, and this accounts for the 170° figure for the cam referred to hereinabove. In one embodiment of the invention, the maximum observed amplitude of the reverse oscillation, as measured from the second dead-center position, was about 120°. (This occurred when the circuit-breaker closing mechanism 11–18 was operated toward closed position by operator 10 with the trip latch 18 retracted). If the cam maintains the main pawl 66 retracted only during such travel, adequate protection against collisions will be provided, but even greater protection is provided by extending the collision-preventing surface over about 170°. The collision-preventing surface 75 cannot be extended counterclockwise appreciably beyond its terminal position of FIG. 2 since when the flywheel 30 is at rest in its position of FIG. 2, the pawl must be extended in readiness for being engaged by abutment 64 during a subsequent normal spring-recharging operation, as will soon be apparent.

The driving member 60 is driven by motor 61 in a counterclockwise direction immediately following the above-described spring-discharge to commence a spring-charging operation. A typical position of the driving member 60 at the start of such a recharging operation is shown in FIG. 2. After the driving member 60 has been driven counterclockwise through approximately 135° from its position of FIG. 2, the abutment 64 on the driving member engages the working face 72 of main pawl 66 and drives the main pawl together with the flywheel 30 through a charging stroke into their position of FIG. 1.

During a recharging operation, motor 61 drives driving member 60 at a relatively low speed compared to the speed of the flywheel during spring-discharge. Typically, several seconds are required before the motor can drive driving member 60 through approximately the $\frac{1}{3}$ to $\frac{1}{2}$ revolution required to produce engagement between abutment 64 and main pawl 66. This is a sufficiently long period to assure that the above-described oscillations of the closing spring have damped out by the time abutment 64 reaches the main pawl 66 and begins transmitting recharging energy from the motor to the spring.

FURTHER PROTECTION AGAINST COLLISIONS RESULTING FROM OSCILLATIONS

It is possible under certain rather remote conditions that the abutment 64 will be in a location outside the protective shield of cam 73 when the above-described oscillations of the driven member are occurring at the end of a spring-discharging operation. As pointed out in the aforesaid Barkan application, the chances for a damaging collision between the main pawl 66 and abutment under such conditions are materially reduced by the fact that the pawl (66) is carried by the driven member (30) instead of by the driving member (60). In this regard, the driven member 30, being spring driven, moves at high speeds during much of the above-described oscillatory travel. This high-speed motion produces centrifugal force on the main pawl 66 that biases the pawl radially outward and during periods of high-speed motion holds the main pawl in its retracted position on the flywheel 30, thus reducing the chance for a collision between the main pawl and the abutment. A stop 80 on the flywheel prevents excessive retraction of the main pawl when it is acted upon by high values of centrifugal force. The spring 69 that biases the main pawl toward its extended position is selected so that it has adequate strength to return the pawl to its extended position against the usual frictional opposition but yet is sufficiently weak to allow the pawl to be actuated by centrifugal force into its retracted position when the flywheel is moving at high velocity during the above-described oscillations.

Although there is insufficient centrifugal force to retract the main pawl or to hold it retracted when the flywheel is traveling at a low velocity during the above-described oscillations, this is not a significant disadvantage because a collision between the main pawl and the abutment presents little chance for damage when the flywheel is moving at a low velocity.

To further aid in retracting the main pawl during reverse rotation of the flywheel in the course of the above-described oscillations, the main pawl is designed in such a way that its center of gravity is located radially beyond a reference circle 85 that includes the pivot axis of the pawl and has its center coinciding with the central axis of flywheel 30. This location of the main pawl's center of gravity causes high tangential acceleration of the flywheel during its reverse movement to produce a radially outward force on the main pawl tending to retract it.

A MANUAL SLOW-CLOSING OPERATION as pointed out hereinabove, it is sometimes necessary to manually close the circuit breaker at low speed to allow for performance of certain testing and maintenance procedures. Broadly speaking, we effect such a manual slow-closing by manually rotating flywheel 30 from its position of FIG. 1 into its position of FIG. 3 without assistance from the closing spring 40.

As a first step, we disable, or "gag," the closing spring while in its charged condition so that it is unable to discharge. This gagging is accomplished by pinning together the two guide elements 83 and 82 within compression spring 40. These guide elements include a rod 83 fixed to one end of the compression spring 40 and a tube 82 fixed to the opposite end of the compression spring and slidably receiving the rod 83. When the compression spring is in its charged condition of FIG. 1, two radially-extending holes provided in these parts 80 and 82 register, and a gag pin 84 is slipped into these registering holes to block spring-discharge. When the spring is thus gagged, the entire spring assembly 40, 42, 83, 82, 84 is free to move as a unit with the crank pin 34 when the flywheel 30 is rotated. The pivot 42 at the outer end of the spring 40 is releasably carried in a suitable stationary support 86 and is moved out of this support when the flywheel 30 is so rotated while the closing spring is gagged, thus allowing the spring assembly 40, 42, 83, 82, 84 to move as a unit, as above-described, with the crank pin 34. A suitable guide (not shown), e.g., a long leaf spring having one end fixed and one end connected to pivot 42, is provided to control the motion of pivot 42 when it is released from support 86. This guide steers the pivot 42 back into support 86 when the flywheel 30 is returned to its position of FIG. 1

Figure 3:
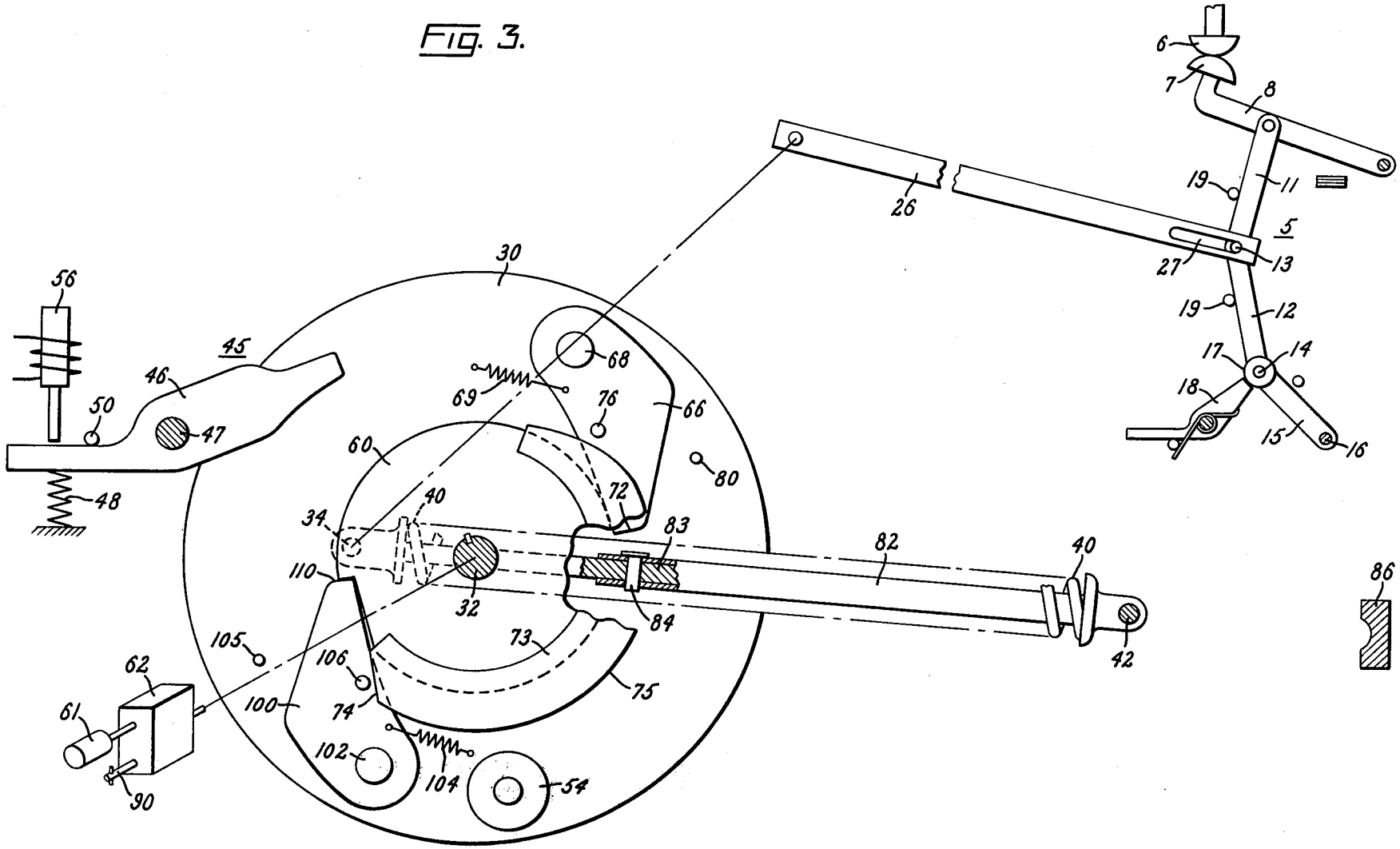
FIG. 3 is a schematic showing depicting the parts immediately after a manual slow-closing operation of the circuit breaker.

The next step in carrying out a manual slow-close operation is to disable stop 45 and manually rotate the driving member 60 counterclockwise until such rotation drives the flywheel 30 counterclockwise from its position of FIG. 1 into its position of FIG. 3. If driving member 60 is initially in its position of FIG. 1, approximately 350° of movement of the driving member 60 will be needed to complete circuit-breaker closing, as will soon appear more clearly. This manual rotation of driving member 60 is effected by manually cranking an intermediate shaft 90 in the reduction gearing 62. This intermediate shaft 90 is adapted to receive a conventional crank (not shown) that can be actuated to rotate shaft 90 and, hence, the output shaft 32 of the reduction gearing. Such manual rotation of shaft 32 is transmitted through driving member 60 to the flywheel 30 by means which will now be described.

For transmitting manually-developed force from driving member 60 to flywheel 30 (while closing spring 40 is gagged) in order to rotate the flywheel counterclockwise out of its position of FIG. 1, we provide an auxiliary pawl 100, preferably identical to the main pawl 66. This auxiliary pawl 100 is pivotally mounted on a pivot pin 102 carried by flywheel 30. In a preferred form of the invention, the axis of pivot pin 102 is located in a position on flywheel 30 spaced 180° from the axis of the pivot pin 68 of the main pawl and at the same radial distance from the central axis of shaft 32. A tension spring 104 biases auxiliary pawl 100 in a clockwise direction about the axis of pivot pin 102. A stop 105 on the flywheel 30 limits the extent to which the auxiliary pawl can be pivoted in a counterclockwise direction about its pivot pin 102. A follower pin 106 carried by the auxiliary pawl is arranged to cooperate with cam 73 in a manner soon to be described. Follower pin 106 on the auxiliary pawl is preferably angularly spaced by 180° from follower pin 76 on the main cam. The auxilairy pawl has a working face 110 that is adapted to engage abutment 64 on driving member 60 when abutment 64 angularly registers with face 110, assuming the auxiliary pawl is not then disabled, or retracted, by cam 73. In the embodiment of FIGS. 1–3, so long as the follower pin 106 is not on the collision-preventing portion 75 of cam 73, working face 110 of auxiliary pawl 100 is free to engage abutment 64 (i.e., the auxiliary pawl 100 is enabled, or extended). In the embodiment of FIGS. 1–3, the stationary cam 73 is shaped so that for the most part, though not always, whenever main pawl 66 is disabled by the cam, the auxiliary pawl 100 is enabled, or extended. (This is not the case with the embodiments of FIGS. 4 and 5, as will soon appear more clearly).

Assume now that the closing spring 40 has been gagged, the stop 45 disabled, and that the driving member 60 is being manually rotated counterclockwise from its position of FIG. 1 (with the flywheel 30 stationary, being held stationary by circuit-breaker opening spring 9). After about 180° of such rotation of driving member 60, the abutment 64 on driving member 60 will engage the working face 110 on auxiliary pawl 100. Thereafter, while this engagement is being maintained, driving member 60 is further manually rotated in a counterclockwise direction through approximately 170° into its position of FIG. 3, thereby driving the flywheel 30 counterclockwise from its position of FIG. 1 to its position of FIG. 3. This counterclockwise rotation of the flywheel is transmitted through link 26 to the circuit breaker mechanism to effect the desired slow-closing of the circuit breaker.

RESTORING THE OPERATING DEVICE TO ITS POSITION OF FIG. 1

After this slow manual-close operation, the operating device 10 can be restored to its position of FIG. 1 by rotating the driving member 60 counterclockwise through approximately 360° from its position of FIG. 3.

Initial counterclockwise rotation of driving member 60 slightly past the position of FIG. 3 carries the flywheel 30 into a position where auxiliary pawl 100 is retracted by cam 73. Just ahead of this same point, main pawl 66, which had been held retracted by cam 73, moves off cam 73 and is restored to its extended position.

Continued counterclockwise motion of driving member 60 into a position located approximately 180° from the position of FIG. 3 carries the abutment 64 into engagement with working face 72 of the then-extended main pawl 66. Flywheel 30 remains stationary during this latter travel of driving member 60. When abutment 64 and main pawl 66 have thus engaged, the driving member 60 is further manually rotated counterclockwise through about 180°, carrying flywheel 30 through the same angular travel by forces imparted through the then-engaged abutment 64 and main pawl 66. This latter travel of flywheel 30 carries spring assembly 40, 42, 83, 82, 84 back to its position of FIG. 1, where its outer end is re-engaged in its support 86. Stop 45 has then been allowed to reset to its blocking position and thus blocks flywheel 30 in its position of FIG. 1. The gag pin 84 is then removed from guides 83, 82 in closing spring 40, thus enabling the closing spring. The operating device 10 is then completely reset and prepared to function in its normal manner to produce circuit-breaker closing when called upon.

GENERAL DISCUSSION

Consideration was given to utilizing the main pawl 66 for a manual slow-closing operation, but it will be noted that when the parts are in the position of FIG. 1, the main pawl is retracted and therefore uncoupled from abutment 64. Assuming that closing spring 40 is gagged when the parts are in the position of FIG. 1, and assuming (for discussion purposes) that auxiliary pawl 100 is not present, driving member 60 could be rotated in either direction indefinitely without moving flywheel 30. In other words, under the assumed conditions, main pawl 66 would remain uncoupled from abutment 64, and slow-closing forces could not be transmitted to flywheel 30.

One can possibly conceive of ways for recoupling main pawl 66 and abutment 64 and defeating cam 73 so that the cam cannot uncouple the pawl and abutment during movement past the position of FIG. 1, but this approach involves many complications and would most likely depend for its effectiveness upon following precisely-defined instructions.

Our slow-close arrangement, on the other hand, can be easily operated to produce its intended result simply by cranking the intermediate shaft 90 once the closing spring 40 has been gagged and the stop means 45 released. Approximately one full revolution of the shaft 32 from its position of FIG. 1 completes a slow-close operation of the circuit breaker, and another full revolution resets the parts to their position of FIG. 1.

Auxiliary pawl 100 does not in any significant way interfere with normal closing operations. When a normal closing operation occurs, abutment 64 on driving member 60 is in a position where it is protected by cam 73 from engagement by auxiliary pawl 100. Under these conditions, auxiliary pawl 100 is held retracted by cam 73 wherever the flywheel 30 carries the working face 110 of the auxiliary pawl past abutment 64. It will be apparent from FIG. 2 that the cam 73 would continue to provide such protection despite the previously-described oscillations of flywheel 30 about its position of FIG. 2 at the end of a closing operation.

It is pointed out hereinabove that under certain remote conditions, abutment 64 may be located outside the protective shield of cam 73 during oscillations of the flywheel occurring at the end of a spring-discharging operation. Since the auxiliary pawl, like the main pawl, is mounted on flywheel 30 and is substantially identical to the main pawl, the auxiliary pawl is protected against damaging collisions with abutment 64 under these conditions in the same way as described with respect to the main pawl. More specifically, the auxiliary pawl is so protected by being retracted through centrifugal force aided by tangential acceleration of the flywheel during high-speed oscillations.

It will be apparent that we have been able to provide for the desired manual slow-closing without the need for major modifications in the basic structure of the operating device 10. In the embodiment of FIGS. 1–3, the primary structural change has been simply to add the auxiliary pawl 110 to flywheel 30 in its disclosed position spaced 180° from main pawl 66. As a further advantage, this auxiliary pawl can be identical in structure to the main pawl, thus simplifying manufacturing and maintenance procedures.

MODIFIED EMBODIMENT OF FIGS. 4 AND 5

Figure 4:
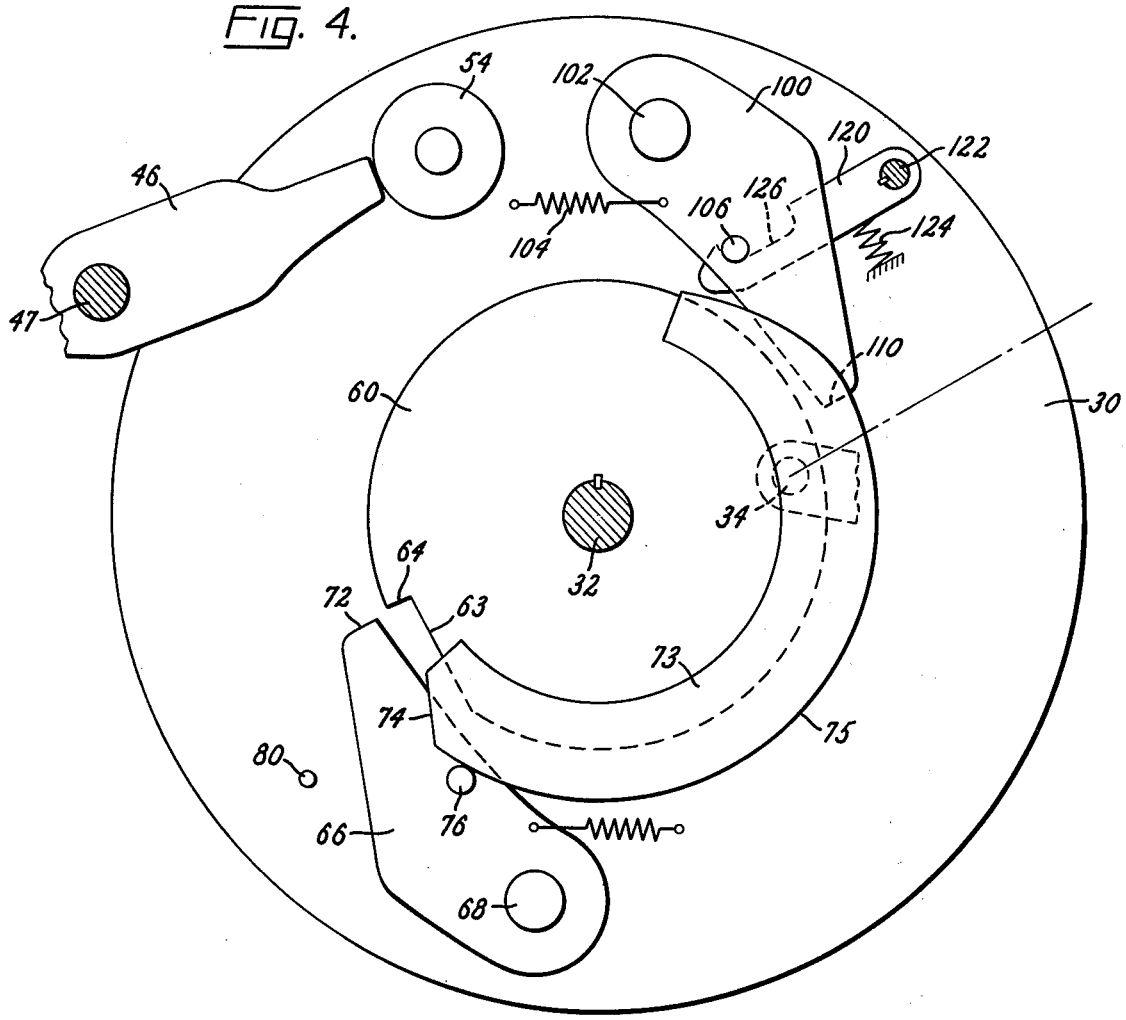
FIG. 4 is a schematic showing of a modified form of the invention depicting the parts in a position corresponding to that of FIG. 1.

FIG. 4 shows a modified form of the invention, depicting the flywheel 30 and the driving member 60 in the same positions as depicted in FIG. 1. In this modified form, holding means comprising a releasable catch 120 is provided for the auxiliary pawl 100. This catch 120 is keyed to a pivot pin 122 rotatably mounted on flywheel 30. Catch 120 is biased clockwise about the axis of pivot pin 122 by a compression spring 124. Catch 120 has a notch 126 in its front surface that is adapted to receive a portion of the follower pin 106 of the auxiliary pawl 100 when auxiliary pawl 100 is retracted, thereby holding the auxiliary pawl retracted until manually released. Manual release of the auxiliary pawl is effected by suitably rotating pivot pin 122 counterclockwise against the bias of spring 124 through a short distance from its position of FIG. 4. When this is done, the reset spring 104 of the auxiliary pawl pivots the auxiliary pawl counterclockwise into the position shown in FIG. 5 (which corresponds to the position of FIG. 1).

Figure 5:
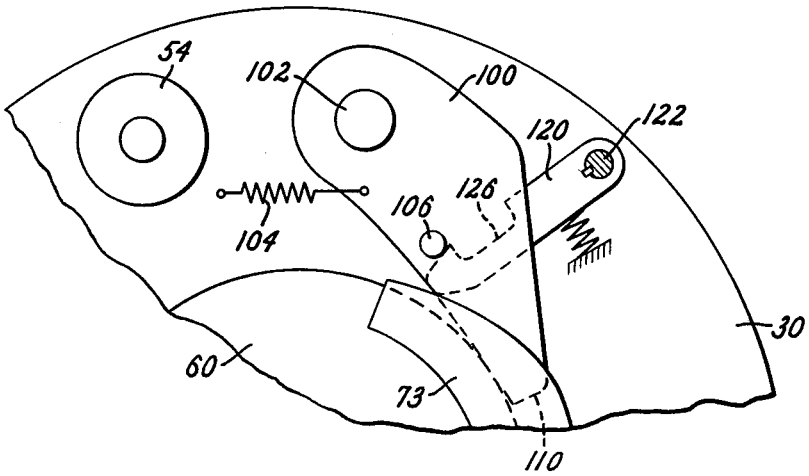
FIG. 5 shows a portion of the device of FIG. 4 after the auxiliary pawl has been released from its retracted position.

In the modified embodiment of FIGS. 4 and 5, under normal operating conditions the auxiliary pawl is held retracted by catch 120. The catch is released only when it is desired to effect a manual slow-close operation and during the manual slow-close operation. After the auxiliary pawl has moved into its non-retracted position of FIG. 1 following release of the catch, the pawl's working face 110 is free to engage abutment 64 on driving member 60 when driving member 60 is rotated counterclockwise from its position of FIG. 4 to bring the abutment into angular registry with working face 110. A manual slow-close operation is then effected in the same manner as described hereinabove, i.e., by driving the parts 60 and 30 counterclockwise from their position of FIG. 1 into their position of FIG. 3.

After such a manual slow-close operation, the driving member 60 is rotated counterclockwise through a small amount of additional travel, causing cam 73 to retract the auxiliary pawl. When the auxiliary pawl is so retracted, catch 120 is biased into its locking position by spring 124, thus holding auxiliary pawl 100 retracted. The parts 60 and 30 are thereafter reset into their position of FIG. 1 in the same way as described hereinabove under the heading "Restoring the Operating Device to its Position of FIG. 1".

Auxiliary pawl 100 after thus being locked in its retracted position will remain retracted by catch 120 until deliberately released by a manual operation of shaft 122 of the catch.

It will be apparent from the above description that, in this modified embodiment, we have provided manually-controlled holding means that holds the auxiliary pawl retracted at essentially all times except during or in preparation for a manual slow-close operation. When such slow-close operation has been performed, the auxiliary pawl is automatically restored to its retracted condition by a slight additional rotation of driving member 60, as described hereinabove.

This feature of normally holding the auxiliary pawl retracted provides further assurance against any unintentional collision of abutment 64 and the auxiliary pawl 100 and, more specifically, assures that the auxiliary pawl will be protected from a damaging collision with abutment 64 in the remote event that the motor cut-off switch (not shown) fails to operate after a spring-charging operation and allows the driving member 60 to continue rotating counterclockwise past its position of FIG. 1.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

We claim:

1. In a stored-energy operating device for closing a circuit breaker, (a) a spring, (b) a rotatable spring-controller mounted for rotation between first and second angularly-spaced dead-center positions with respect to said spring, (c) means for transmitting charging forces to said spring in response to rotation of said spring-controller in a forward direction toward said first dead-center position, (d) said spring acting to discharge and thereby further to rotate said spring-controller in a forward direction when said spring-controller has been rotated in a forward direction past said first dead-center position, (e) releasable stop means coacting with said spring-controller for blocking said further forward rotation of said spring-controller when said spring-controller reaches an overcenter position slightly past said first dead-center position, said stop means being releasable to permit said spring to rapidly discharge and continue forward rotation of said spring-controller from said overcenter position into said second dead-center position, (f) means for closing said circuit breaker in response to forward rotation of said spring-controller into said second dead-center position, (g) means for forwardly rotating said spring-controller from said second to said first dead-center position, thereby charging said spring, comprising:

(g1) cooperating pawl and abutment elements (g2) a rotatable driving member for said spring-controller carrying one of said elements thereon, (g3) the other of said elements being mounted on said spring-controller and arranged to be driven by said one element when said driving member is driving said spring-controller in a forward direction toward said first dead-center position, (h) cam means effective after said spring-controller has passed in a forward direction through said first dead-center position but before said stop means has become effective to block forward rotational movement of said spring-controller for uncoupling said pawl and abutment elements so that said driving member is not imparting driving force to said spring-controller when said stop is blocking said spring-controller, (i) an auxiliary element of the same type as said other element mounted on said spring-controller in a position angularly spaced from the location of said other element, (j) said auxiliary element being engageable with said one element when said driving member is manually rotated in a forward direction through predetermined travel past the normal terminal position of said driving member at the end of a charging operation, additional manual rotation of said driving member in a forward direction while said one element and said auxiliary element are engaged acting to rotate said spring-controller into said second dead-center position, thereby to produce a manually-powered circuit-breaker closing operation, and (k) means for effectively disabling said spring while said spring-controller is being manually rotated through said circuit-breaker closing operation.

2. The apparatus of claim 1 in combination with means for holding said spring-controller stationary while said driving member is being manually rotated through said predetermined travel past the normal terminal position of said driving member at the end of a charging operation, thus enabling said one element to move into driving engagement with said auxiliary element in preparation for a manually-powered closing operation.

3. The apparatus of claim 1 in which said spring-disabling means of (k) comprises: means for holding said spring in a charged condition and for carrying said charged spring with said spring-controller while said spring-controller is being manually rotated through said circuit-breaker closing operation.

4. The apparatus of claim 1 in combination with holding means for preventing engagement of said one element and said auxiliary element during a normal spring-charging operation and during a spring-discharging operation, and manual means for disabling said holding means in preparation for and during a manual slow-close operation.

5. The apparatus of claim 4 in which said cam means restores said holding means to its engagement-preventing condition responsive to a small amount of further rotation of said driving member following a manual slow-close operation.

6. In a stored-energy operating device, for closing a circuit breaker, (a) a spring, (b) a rotatable spring-controller mounted for rotation between first and second angularly-spaced dead-center positions with respect to said spring, (c) means for transmitting charging forces to said spring in response to rotation of said spring-controller in a forward direction toward said first dead-center position, (d) said spring acting to discharge and thereby further to rotate said spring-controller in a forward direction when said spring-controller has been rotated in a forward direction past said first dead-center position, (e) releasable stop means coacting with said spring-controller for blocking said further forward rotation of said spring-controller when said spring-controller reaches an overcenter position slightly past said first dead-center position, said stop means being releasable to permit said spring to rapidly discharge and continue forward rotation of said spring-controller from said overcenter position into said second dead-center position, (f) means for closing said circuit breaker in response to forward rotation of said spring-controller into said second dead-center position, (g) means for forwardly rotating said spring-controller from said second to said first dead-center position, thereby charging said spring, comprising:

(g1) a rotatable driving member for said spring-controller having an abutment thereon, (g2) a main pawl mounted on said spring-controller and arranged to be driven by said abutment when said driving member is driving said spring-controller in a forward direction toward said first dead-center position, (h) cam means effective after said spring-controller has passed in a forward direction through said first dead-center position but before said stop means has become effective to block forward rotational movement of said spring-controller for releasing said main pawl from driven relationship with said abutment so that said driving member is not imparting driving force to said spring-controller when said stop is blocking said spring-controller, (i) an auxiliary pawl mounted on said spring-controller in a position angularly spaced from the location of said main pawl, (j) said auxiliary pawl being arranged to engage said abutment when said driving member is manually rotated relative to said spring-controller in a forward direction through predetermined travel past the normal terminal position of said driving member at the end of a charging operation, additional manual rotation of said driving member in a forward direction while said abutment and said auxiliary pawl are engaged acting to rotate said spring-controller into said second dead-center position, thereby producing a manually-powered circuit-breaker closing operation, (k) and means for effectively disabling said spring while said spring-controller is being manually rotated through said circuit-breaker closing operation.

7. The apparatus of claim 6 in combination with means for holding said spring-controller stationary while said driving member is being manually rotated through said predetermined travel past the normal terminal position of said driving member at the end of a charging operation, thus enabling said abutment to move into driving engagement with said auxiliary pawl in preparation for a manually-powered closing operation.

8. The apparatus of claim 6 in which said cam means acts to release said auxiliary pawl from driven engagement with said abutment when said spring-controller is manually driven in a forward direction past said second dead-center position by forces transmitted through said driving member and said auxiliary pawl.

9. The apparatus of claim 8 in which said cam means, upon said release of said auxiliary pawl, allows said main pawl to return to an enabled position where said main pawl is capable of engaging said abutment when said abutment and said main pawl effectively angularly align.

10. The apparatus of claim 9 in which continued forward rotation of said driving member after release of said auxiliary pawl carries said abutment into effective engagement with said main pawl, and continued forward rotation of said driving member after said effective engagement with said main pawl has been established carries said spring-controller into substantially said overcenter position, where said spring can be freed from the disability imposed thereon during a manually-powered closing operation, thus restoring the operating device to a condition for producing a spring-powered circuit-breaker closing operation.

11. The apparatus of claim 6 in which said spring-disabling means of (k) comprises: means for holding said spring in a charged condition and for carrying said charged spring with said spring-controller while said spring-controller is being manually rotated through said circuit-breaker closing operation.

12. The apparatus of claim 6 in which: (a) each of said pawls has a working face adapted to engage said abutment, (b) each of said pawls: (i) is capable of engaging said abutment when said pawl is in an extended position and said abutment effectively angularly registers with the working face on said pawl but (ii) is incapable of engaging said abutment when said pawl is in a retracted position even though said abutment and the working face on said pawl effectively angularly register, and (c) means is provided for holding said auxiliary pawl in a retracted position while said main pawl is extended and for holding said main pawl in a retracted position while auxiliary pawl is extended.

13. The apparatus of claim 6 in which: (a) said spring-controller oscillates about said second dead-center position immediately following said rapid discharge of said spring, (b) said oscillations of said spring-controller develop forces on said pawls that actuate the pawls into their retracted position if not then already retracted.

14. The apparatus of claim 13 in which said oscillation-developed forces of (b) are centrifugal forces effective during high speed reverse motion of said spring-controller to actuate said pawls into said retracted positions if not then already retracted.

15. The apparatus of claim 6 in which said auxiliary pawl is located in a position on said spring-controller effectively angularly spaced by approximately 180 degrees from said main pawl.

16. The apparatus of claim 15 in which: (a) each of said pawls has a working face adapted to engage said abutment, (b) each of said pawls: (i) is capable of engaging said abutment when said pawl is in an extended position and said abutment effectively angularly registers with the working face on said pawl but (ii) is incapable of engaging said abutment when said pawl is in a retracted position even though said abutment and the working face on said pawl effectively angularly register, and (c) means is provided for holding said auxiliary pawl in a retracted position while said main pawl is extended and for holding said main pawl in a retracted position while auxiliary pawl is extended.

17. The apparatus of claim 15 in which: (a) each of said pawls has a working face adapted to engage said abutment, (b) each of said pawls: (i) is capable of engaging said abutment when said pawl is in an extended position and said abutment effectively angularly registers with the working face on said pawl but (ii) is incapable of engaging said abutment when said pawl is in a retracted position even though said abutment and the working face on said pawl effectively angularly register, (c) means is provided for holding said auxiliary pawl in a retracted position while said main pawl is extended and for holding said main pawl in a retracted position while auxiliary pawl is extended, and (d) said cam means acts to hold said main pawl retracted while said spring-controller is moving from said overcenter position to a position slightly ahead of said second dead-center position but allows said main pawl to be extended when said spring-controller reaches said second dead-center position.

18. The apparatus of claim 6 in combination with holding means for holding said auxiliary pawl in a retracted position wherein said auxiliary pawl is incapable of engaging said abutment, and manually-controlled means for disabling said holding means, thereby releasing said auxiliary pawl and allowing said auxiliary pawl to move into an extended position wherein said auxiliary pawl can be engaged by said abutment during said additional manual rotation of said driving member which produces manually-powered circuit-breaker closing.

19. The apparatus of claim 18 in which said cam means cooperates with said auxiliary pawl after release thereof to restore said auxiliary pawl to its retracted position responsive to a small amount of further rotation of said driving member following a manual slow-close operation.

20. The apparatus of claim 18 in which said holding means retains said auxiliary pawl in said retracted position during a normal spring-charging operation and during a spring-discharging operation.

21. The apparatus of claim 6 in combination with holding means for holding said auxiliary pawl in a retracted position wherein said auxiliary pawl cannot engage said abutment during a normal spring-charging operation and during a spring-discharging operation, and manually-controlled means for disabling said holding means in preparation for and during a manual slow-close operation, whereby said auxiliary pawl is then free to engage said abutment.

22. The apparatus of claim 21 in which said cam means acts to restore the effectiveness of said holding means to hold said auxiliary pawl retracted in response to a small amount of further rotation of said driving member following a manual slow-close operation.

* * * * *